US008233629B2

(12) United States Patent
Johnston

(10) Patent No.: US 8,233,629 B2
(45) Date of Patent: Jul. 31, 2012

(54) INTERAURAL TIME DELAY RESTORATION SYSTEM AND METHOD

(75) Inventor: James D. Johnston, Redmond, WA (US)

(73) Assignee: DTS, Inc., Calabasas, CA (US)

( * ) Notice: Subject to any disclaimer, the term of this patent is extended or adjusted under 35 U.S.C. 154(b) by 625 days.

(21) Appl. No.: 12/204,471

(22) Filed: Sep. 4, 2008

(65) Prior Publication Data

US 2010/0054482 A1 Mar. 4, 2010

(51) Int. Cl.
*H04R 5/00* (2006.01)

(52) U.S. Cl. ..... 381/17; 381/1; 381/18; 704/E19.005; 704/502

(58) Field of Classification Search ..... 381/17–23, 381/1, 2, 119; 704/500, 502, 500.502, E19.005
See application file for complete search history.

(56) References Cited

U.S. PATENT DOCUMENTS

| | | | | |
|---|---|---|---|---|
| 5,136,650 | A * | 8/1992 | Griesinger | 381/22 |
| 5,652,770 | A * | 7/1997 | Eatwell | 375/350 |
| 6,424,939 | B1 * | 7/2002 | Herre et al. | 704/219 |
| 7,027,601 | B1 * | 4/2006 | Johnston | 381/56 |
| 2005/0254446 | A1 * | 11/2005 | Breebaart | 370/315 |

OTHER PUBLICATIONS

International search report & written opinion issued in counterpart international (PCT) application No. PCT/US2009/004673; Filed: Aug. 14, 2009.

* cited by examiner

*Primary Examiner* — Devona Faulk
(74) *Attorney, Agent, or Firm* — Gaurav K. Mohindra; William L. Johnson

(57) ABSTRACT

An apparatus for processing audio data comprising an interaural time delay correction factor unit for receiving a plurality of channels of audio data and generating an interaural time delay correction factor. An interaural time delay correction factor insertion unit for modifying the plurality of channels of audio data as a function of the interaural time delay correction factor.

3 Claims, 4 Drawing Sheets

INTERAURAL TIME DELAY RESTORATION SYSTEM AND METHOD

FIELD OF THE INVENTION

The invention relates to systems for processing audio data, and more particularly to a system and method for restoring interaural time delay in stereo or other multi-channel audio data.

BACKGROUND OF THE INVENTION

When audio data is processed to generate an audio composition, it is common to mix such audio data using a mixer that utilizes panning potentiometers, or other systems or devices that simulate the function of a panning potentiometer. The panning potentiometers can be used to allocate a single input channel to two or more output channels, such as a left and right stereo output, such as to simulate a spatial position between the far left and far right locations relative to a listener. However, such panning potentiometers do not typically add an interaural time difference that would normally be present from a live performance.

SUMMARY OF THE INVENTION

In accordance with the present invention, a system and method are provided for interaural time delay restoration that add a time delay between two or more channels of audio data that corresponds to an estimated interaural delay, based on the relative magnitudes of the channels of audio data.

In accordance with an exemplary embodiment of the present invention, an apparatus for processing audio data is provided. The apparatus includes an interaural time delay correction factor unit for receiving a plurality of channels of audio data and generating an interaural time delay correction factor, such as where the plurality of channels of audio data include panning data with no associated interaural time delay. An interaural time delay correction factor insertion unit modifies the plurality of channels of audio data as a function of the interaural time delay correction factor, such as to add an estimated interaural time delay to improve audio quality.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
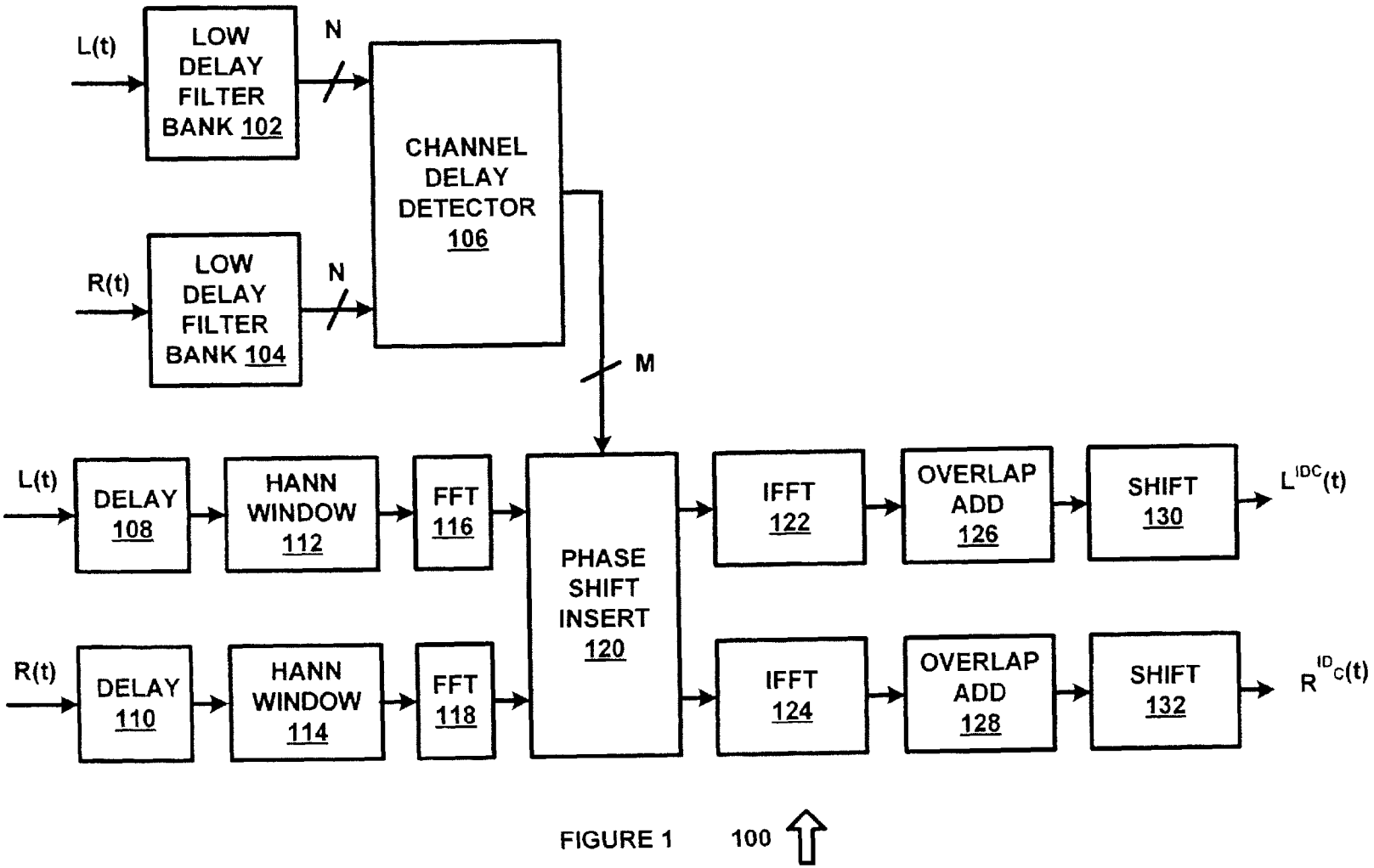
FIG. 1 is a diagram of a system for interaural time correction in accordance with an exemplary embodiment of the present invention.

In the description that follows, like parts are marked throughout the specification and drawings with the same reference numerals, respectively. The drawing figures might not be to scale, and certain components can be shown in generalized or schematic form and identified by commercial designations in the interest of clarity and conciseness.

FIG. 1 is a diagram of a system 100 for interaural time correction in accordance with an exemplary embodiment of the present invention. System 100 can be implemented in hardware, software, or a suitable combination of hardware and software, and can be one or more software systems operating on a digital signal processing platform. As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications or on two or more processors, or other suitable software structures. In one exemplary embodiment, software can include one or more lines of code or other suitable software structures operating in a general purpose software application, such as an operating system, and one or more lines of code or other suitable software structures operating in a specific purpose software application.

System 100 includes low delay filter banks 102 and 104, which receive a left and right channel audio time signal, respectively. In one exemplary embodiment, low delay filter banks 102 and 104 can receive a series of samples of audio data at a sampling frequency, and can process the sampled audio data based on a predetermined number of samples. Low delay filter banks 102 and 104 are used to determine a time delay between peak magnitudes during a time period for plurality of frequency bands. In one exemplary embodiment, the number of frequency bands can be related to the number of barks, equivalent rectangular bandwidths (ERBs), or other suitable psychoacoustic bands of audio data, such that the total number of outputs from low delay filter banks 102 and 104 is equal to the number of barks or ERB's per input sample. Likewise, over sampling can be used to reduce the likelihood of creation of audio artifacts, such as by using multiple filters, each for one of multiple corresponding sub-bands of each frequency band (thus creating a plurality of sub-bands for each associated band), or in other suitable manners.

Channel delay detector 106 receives the inputs from low delay filter banks 102 and 104 and determines a difference correction factor for each of a plurality of frequency bands. In one exemplary embodiment, channel delay detector 106 can generate an amount of phase difference to be added to frequency domain signals to create a time difference, such as between a left and right channel, so as to insert an interaural time delay into a signal in which panning has been used, but which does not incorporate an associated time delay. In one exemplary embodiment, audio data may be mixed using a panning potentiometer to cause an input channel to have an apparent spatial location intermediate to the far left channel and the far right channel for stereo data, or in other suitable manners, including where more than two channels are present. While such panning can be used to simulate spatial location, motion or other effects, the interaural time delays that are associated with live audio data are not recreated by such panning. For example, when a sound source is present to the left side of a listener, there will be a time delay between the time when the audio signal from the source is received at the listener's left ear and the time when the audio signal is received at the listener's right ear. Likewise, as the sound source moves from the left side of the listener to the right side of the listener, the associated time delay will decrease to zero when the sound source is directly in front of the listener and will then increase relative to the right ear. Using a simple panning potentiometer to simulate spatial location or motion fails to create these associated time delays, which can be modeled and inserted in a stereo or other multi-channel audio signal using channel delay detector 106.

Likewise, channel delay detector 106 can also be used to correct for interaural level differences, such as where a time delay exists between the left and right channel but no associated magnitude difference exists. For example, audio processing may cause the levels associated with a panned audio signal to change, so that an audio signal that has been accurately recorded with associated time delays between the left and right channels nevertheless results in left and right channel sound levels that do not reflect the live audio signal. Channel delay detector 106 can also or alternatively be used to model and insert associated level correction factors in a stereo or other multi-channel audio signal.

Channel delay detector 106 outputs a plurality of M correction factors, which are used to insert interaural time differences or level differences into a plurality of channels of audio data. The number of correction factors may be less than the number of low delay filter bank 102 or 104 outputs where over sampling is used to smooth variations within perceptual bands. In one exemplary embodiment, where the perceptual bands are sampled at three times the bandwidth, N will equal three times M.

System 100 includes delays 108 and 110, which receive the left and right time varying audio channel signals and delay the signals by amount corresponding to the delay through low delay filter banks 102 and 104 and channel delay detector 106, minus the delay created by zero-padded Hann windows 112 and 114 and fast Fourier transformers 116 and 118.

Zero-padded Hann windows 112 and 114 modify the time varying audio signals for the left and right channel by an amount so as to create a Hann-windowed modified signal. Zero-padded Hann windows 112 and 114 can be used to prevent discontinuities from being created in the processed signals, which can generate phase shift variations that cause audio artifacts to be generated in the processed audio data. Other types of Hann windows or other suitable processes to prevent discontinuities can also or alternatively be used.

Fast Fourier transformers 116 and 118 convert the time domain left and right channel audio data into frequency domain data. In one exemplary embodiment, fast Fourier transformers 116 and 118 receive a predetermined number of time samples of the time domain signal, which are modified by zero-padded Hann windows 112 and 114 to increase the number of samples, and generate a corresponding number of frequency components of the time domain signal.

Phase shift insert 120 receives the fast Fourier transform data from fast Fourier transformers 116 and 118 and inserts a phase shift in the signals based on the correction factors received from channel delay detector 106, such as by modifying the real and imaginary components of the Fourier transform data for an individual frequency bin or group of frequency bins without modification of the associated magnitude for each bin or group of bins. In one exemplary embodiment, the phase shift can correlate to the angular difference between the electronic channels determined by channel delay detector 106, such that the dominant channel is advanced in phase by one-half of the angular difference and the secondary channel is retarded in phase by one-half of the angular difference.

Inverse fast Fourier transformers 122 and 124 receive the phase shifted frequency domain signals from phase shift insert 120 and perform an inverse fast Fourier transform on the signals to generate a time varying signal. The left and right channel time varying signals are then provided to overlap add 126 and 128, respectively, which performs an overlap add operation on the signal to account for processing by zero-padded Hann windows 112 and 114. Overlap adds 126 and 128 output a signal to shift and add registers 130 and 132, which output a shifted time signal as $L^{idc}$ (t) and $R^{idc}$ (t).

In operation, system 100 allows a signal that includes panning with no associated interaural time difference to be compensated so as to insert an interaural time difference. Thus, system 100 restores interaural time differences that would normally occur in audio signals and thus improves the audio quality.

Figure 2:
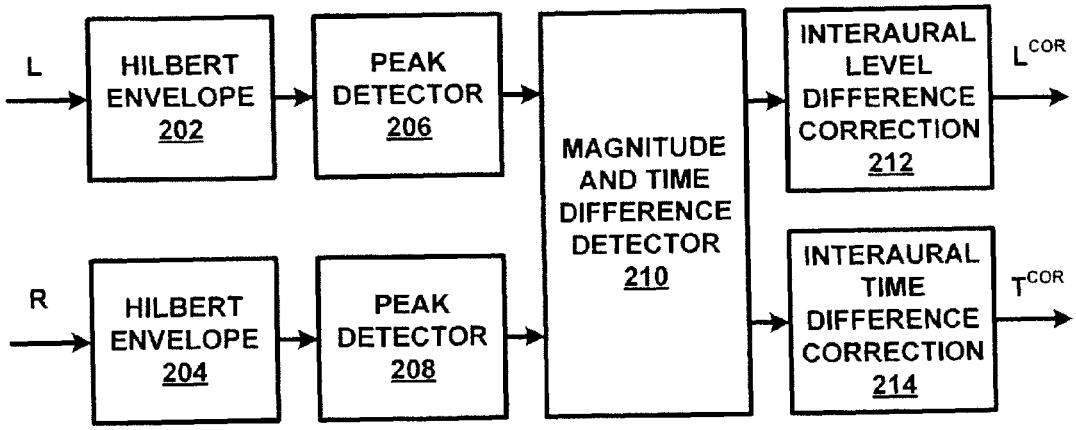
FIG. 2 is a diagram of a system for detecting differences in peaks of left and right channel audio data for specific frequency bands in accordance with an exemplary embodiment of the present invention.

FIG. 2 is a diagram of a system 200 for detecting differences in peaks of left and right channel audio data for specific frequency bands in accordance with an exemplary embodiment of the present invention. System 200 can be used to detect peaks between left and right channel data for separate frequency bands of the audio data and to generate a correction factor for each frequency band.

System 200 includes Hilbert envelopes 202 and 204, which receive a left and right time domain signal and generate a Hilbert envelope for a predetermined frequency band of the signals. In one exemplary embodiment, Hilbert envelopes 202 can operate on a smaller number of time domain samples than are processed by fast Fourier transformers 116 and 118 of system 100, so as to allow system 200 to generate correction factors rapidly and to avoid additional delay that might otherwise be generated from converting the time channel time domain data to the frequency domain for generation of the associated correction factors.

Peak detectors 206 and 208 receive the left and right channel Hilbert envelopes, respectively, and determine a peak magnitude and an associated time for the peak magnitude for each signal. The peak and time data is then provided to magnitude and time difference detector 210 which determines whether a time difference exists for the corresponding peak magnitudes. If magnitude and time difference detector 210 determines that there is no corresponding difference between the peak magnitude times, then interaural time difference correction 214 can be used to determine a correction factor angle $T^{COR}$ to be inserted in frequency domain audio data by comparing the magnitude values of the left and right channel peak magnitudes. In one exemplary embodiment, the correction factor angle $T^{COR}$ can be determined by determining the angle a tan 2 (left channel magnitude, right channel magnitude) minus 45 degrees. Likewise, other suitable processes can be used to determine the correction factor angle. A suitable threshold can also be applied, such as to provide for generation of correction factor angles when there is a small time difference between the magnitude peaks.

Interaural level difference correction 212 can be used where the difference between the peaks for the left and right channel data in time exists, but where the magnitudes are otherwise equal. In this exemplary embodiment, the magnitudes can be adjusted by a correction factor $L^{COR}$ so as to give the channel having the leading audio peak a higher value and the channel with the trailing audio peak a lower value, such as by subtracting $L^{COR}$ from the lagging channel, by adding $0.5*L^{COR}$ to the leading channel and subtracting $0.5*L^{COR}$ from the lagging channel, or in other suitable manners. A threshold can also be used for interaural level difference correction 212, such as to identify a threshold time difference above which level correction will be applied, and a threshold level difference below which level correction will not be applied.

In operation, system 200 can be used to generate time and level difference correction factors for left and right signals, such as to generate interaural time difference correction factors for signals that have left or right panning but no associated time differences, and to generate level corrections for signals where interaural time differences exist but no associated panning magnitudes are present.

Figure 3:
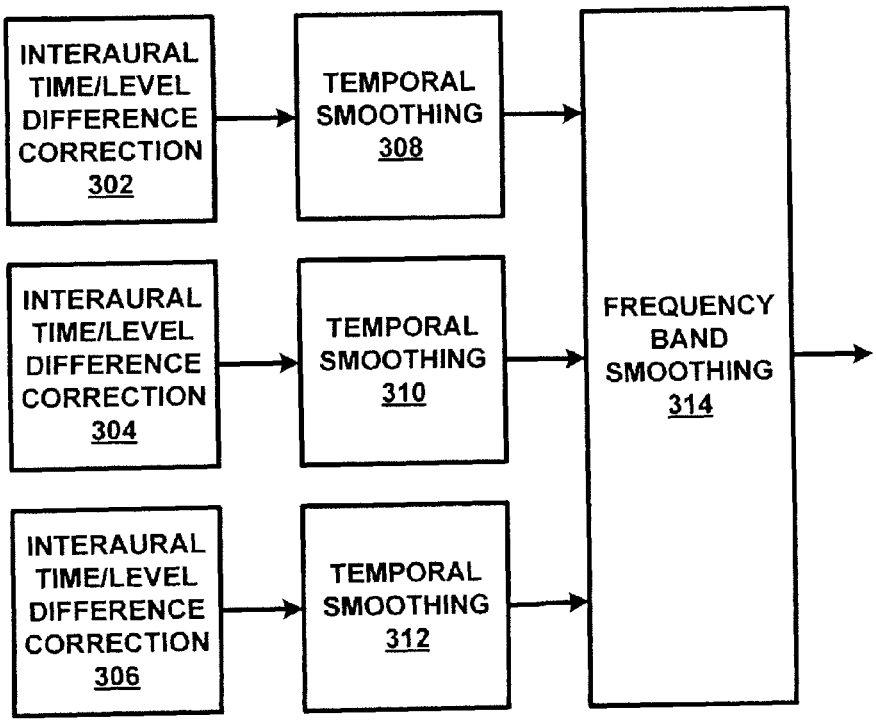
FIG. 3 is a diagram of a system for smoothing interaural time and level differences in accordance with an exemplary embodiment of the present invention.

FIG. 3 is a diagram of a system 300 for smoothing interaural time and level differences in accordance with an exemplary embodiment of the present invention. System 300 includes interaural time and level difference correction units 302 through 306, which each generate an interaural time and/or level difference correction factor for a different frequency band. In one exemplary embodiment, the frequency bands can be fractions of a bark, ERB, or other suitable psychoacoustic frequency bands, such that system 300 can be used to generate a single correction factor for the psychoacoustic frequency band based upon subcomponents of that frequency band.

Temporal smoothing units 308 through 312 are used to perform temporal smoothing on the outputs from interaural time or level difference correction systems 302 through 306, respectively. In one exemplary embodiment, temporal smoothing units 308 through 312 can receive a sequence of outputs from interaural time and level difference correction units 302 through 306, and can store the sequence for a predetermined number of samples, such as to allow variations between successive samples to be averaged, or smoothed in other manners.

Frequency band smoothing unit 314 receives each of the interaural time or level difference correction factors from interaural time or level difference correction units 302 through 306, and performs smoothing on the interaural time or level difference correction factors. In one exemplary embodiment, where a bark or ERB frequency band has been divided into thirds, frequency band smoothing 314 can average the three frequency correction factors for the associated frequency band, can determine a weighted average, can use temporally smoothed factors, or can perform other suitable smoothing processes. Frequency band smoothing 314 generates a single phase correction factor for each frequency band.

In operation, system 300 performs smoothing on a time, frequency, time and frequency, or other suitable bases for interaural time or level difference correction factors that are generated by analyzing left and right channel audio data to detect panning settings without associated level or time differences. System 300 thus helps to avoid the creation of audio artifacts by ensuring that changes between the interaural time or level difference correction factors do not change rapidly.

Figure 4:
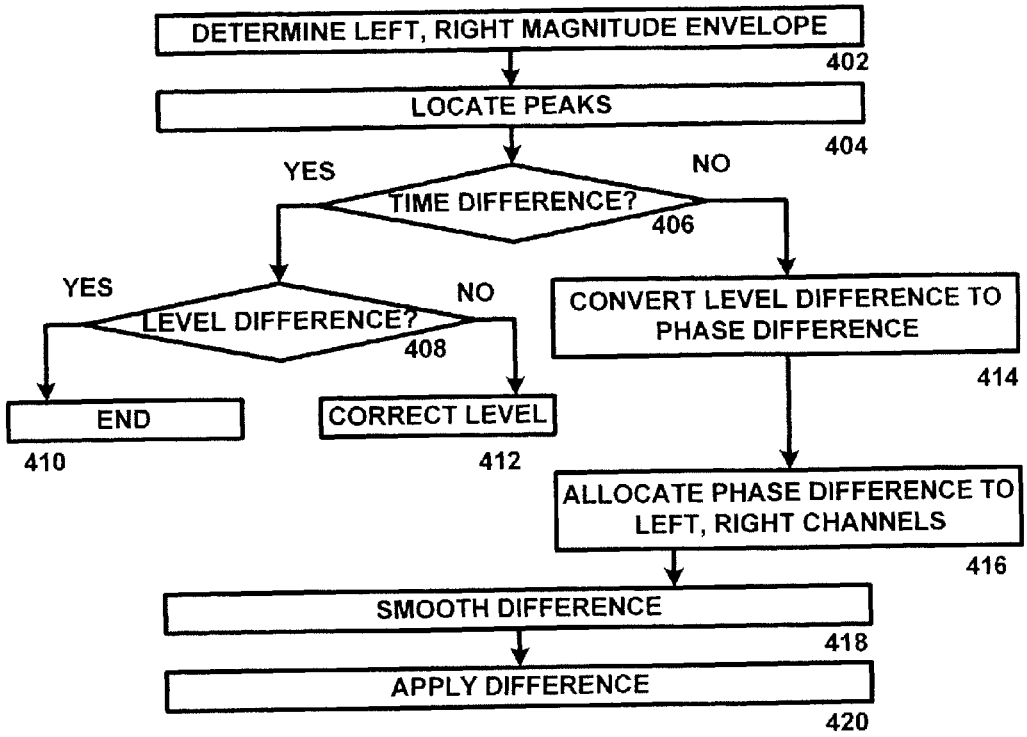
FIG. 4 is a diagram of a method for processing audio data to introduce an interaural time or level difference in accordance with an exemplary embodiment of the present invention.

FIG. 4 is a diagram of a method 400 for processing audio data to introduce an interaural time or level difference in accordance with an exemplary embodiment of the present invention. Method 400 begins at 402 where left and right magnitude envelopes are determined. In one exemplary embodiment, a Hilbert envelope detector or other suitable systems can be used to determine a magnitude of a peak for a frequency band, the time associated with the peak, and other suitable data. The method then proceeds to 404.

At 404, the peaks in the magnitude envelopes are detected, in addition to the associated times for the peaks. In one exemplary embodiment, a simple peak detector such as a magnitude detector can be used that detects the associated time interval where the peak occurs. The method proceeds to 406.

At 406, it is determined whether there is a time difference between the peaks for the left and right channel data. In one exemplary embodiment, a time difference can include an associated buffer, such that a time difference is determined not to exist if the time between peaks is less than a predetermined amount. If it is determined that a time difference does exist, such that interaural time delay restoration is not required, the method proceeds to 408 where it is determined whether a level difference exists between the magnitudes of the two signals. If it is determined that a level difference exists, the method proceeds to 410. Otherwise, the method proceeds to 412 where the level between the left and right channel audio data is corrected. In one exemplary embodiment, a leading channel magnitude can be left unchanged whereas a lagging channel magnitude can be decreased by a factor related to the difference between the leading and lagging channels, or other suitable processes can be used.

If it is determined that no time difference exists between the left and right channel magnitude peaks, the method proceeds to 414 where the level difference is converted to a phase correction angle. In one exemplary embodiment, the phase correction angle can be determined from a tan 2 (left channel magnitude, right channel magnitude) minus 45 degrees, or other suitable relationships can be used. The method then proceeds to 416 where the phase difference is allocated to left and right channels. In one exemplary embodiment, the allocation can be performed by equally splitting the phase difference, so as to advance and retard the channels by the same amount. Likewise, weighted differences can be used where suitable or other suitable processes can be used. The method then proceeds to 418.

At 418, the difference between left and right channel phase correction angles is smoothed. In one exemplary embodiment, the difference can be smoothed over time, smoothed based on the phase correction angles of adjacent channels, or in other suitable manners. The method then proceeds to 420.

At 420, the difference correction factor is applied to an audio signal. In one exemplary embodiment, a phase difference corresponding to a time difference can be added in a frequency domain, such as using well-known methods for adding or subtracting time differences in a time signal in the frequency domain by adding or subtracting an associated phase shift in the frequency domain. Likewise, other suitable processes can be used.

In operation, method 400 allows an interaural phase or magnitude correction factor to be determined and applied to a plurality of channels of audio data. Although two exemplary channels have been shown, additional channels of audio data can also be processed where suitable, such as to add an interaural phase or magnitude correction factor to audio data in a 5.1 sound system, a 7.1 sound system, or other suitable sound systems.

Figure 5:
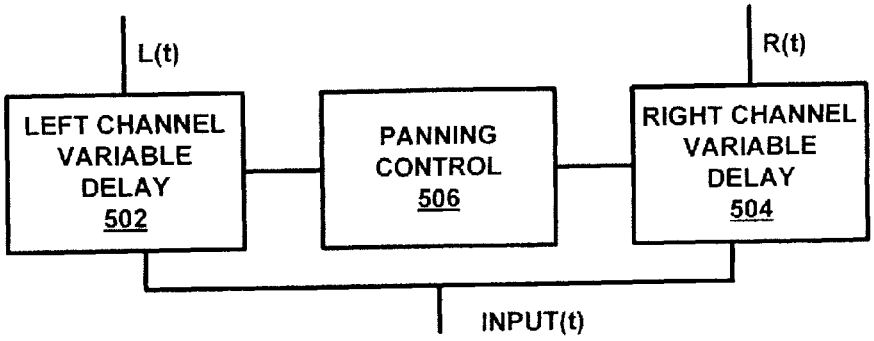
FIG. 5 is a diagram of a system for interaural time delay correction in accordance with an exemplary embodiment of the present invention.

FIG. 5 is a diagram of a system 500 for interaural time delay correction in accordance with an exemplary embodiment of the present invention. System 500 allows interaural time delay to be compensated prior to mixing, so as to generate panning control output that more accurately reflects the interaural time delays associated with sound sources generated at associated physical locations.

System 500 includes left channel variable delay 502, right channel variable delay 504 and panning control 506, each of which can be implemented in hardware, software or a suitable combination of hardware and software, and which can be one or software systems operating on a digital signal processing platform. Panning control 506 allows a user to select a panning setting to allocate a time varying audio data input to a left channel signal and a right channel signal. In one exemplary embodiment, panning control 506 can include associated time delay values for each of a plurality of associated position settings between a virtual left location and a virtual right location. In this exemplary embodiment, panning control 506 can disable the variable delay control where a full left, center or full right position has been selected, as no delay is required for such settings. For settings between the full left, center or full right position of panning control 506, a delay value can be generated that corresponds to an interaural time delay that would be generated for a sound source located at an associated location.

Panning control 506 can also include an active panning feature that allows a user to select active panning, such as where the user intends on panning from left to right or right to left. In this exemplary embodiment, a time delay can be provided for a full left or full right panning control 506 setting, so as to allow the user to pan the audio input without creation of audio artifacts when the panning control 506 setting is moved from the full left or full right settings, as otherwise the time delay would jump from a zero delay for the full left or full right setting to the maximum delay values for panning control 506 settings that are adjacent to the full left or full right setting.

Left channel variable delay 502 and right channel variable delay 504 can be implemented using the interaural time delay correction factor insertion unit of system 100 or in other suitable manners.

In operation, system 500 allows interaural time delays to be added when an audio channel is panned between two output channels, such as a left channel and a right channel or other suitable channels. System 500 can disable the time delay for settings where a time delay is not required.

Figure 6:
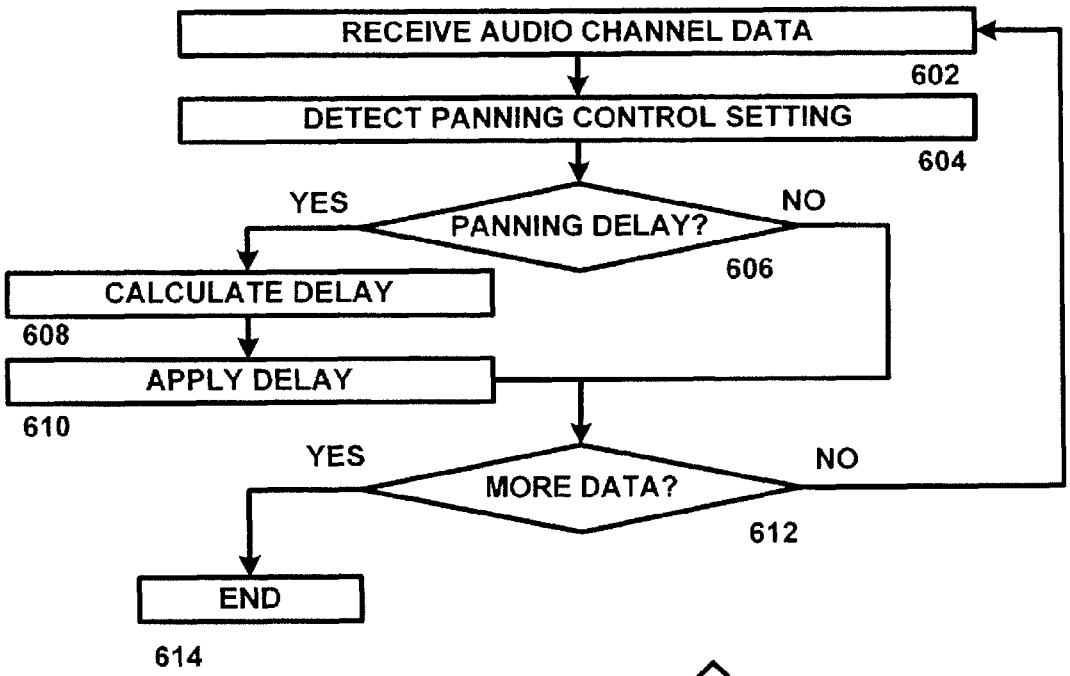
FIG. 6 is a flow chart of a method for controlling an interaural time delay associated with a panning control setting in accordance with an exemplary embodiment of the present invention.

FIG. 6 is a flow chart of a method 600 for controlling an interaural time delay associated with a panning control setting in accordance with an exemplary embodiment of the present invention. Method 600 begins at 602, where time domain audio channel data is received, such as for a user-selected channel. The method then proceeds to 604 where a panning control setting is detected. The panning control can be a potentiometer, a virtual panning control, or other suitable controls. The method then proceeds to 606.

At 606, it is determined whether a panning delay setting is required. In one exemplary embodiment, the panning delay can be disabled for predetermined panning control positions, such as a full left, full right, or center position. In another exemplary embodiment, the panning delay can be generated for the full left or full right positions, such as where a user has selected a panning control setting to allow the user to actively pan between a full left and a full right position, such as to avoid a discontinuity in the generation of time delays when the panning control moves off from the full right or full left position. If it is determined that no panning delay is required, the method proceeds to 612, otherwise the method proceeds to 608.

At 608, an amount of delay is calculated based on the panning control setting. In one exemplary embodiment, a maximum time delay can be generated when the panning control is in the full left or full right position, such as where active panning has been selected. Likewise, where a stationary panning setting has been selected, no time delay is needed for a full left or full right setting (as no associated signal is generated for the opposite channel). For panning control settings between the full right and full left position settings, a time delay corresponding to the time delay at an intermediate position is calculated, where the time delay decreases as the panning control position approaches a center position. The method then proceeds to 610.

At 610, the calculated delay is applied to one or more variable delays. In one exemplary embodiment, the delay can be added to one of the left or right channels, or other suitable delay settings can be used. In another exemplary embodiment, the delay can be added utilizing the interaural time delay correction factor insertion unit of system 100 or in other suitable manners. The method then proceeds to 612.

At 612, it is determined whether additional audio channel data requires processing, such as by determining whether additional data samples are present in a data buffer or in other suitable manners. If additional data processing is required, the method returns to 602, otherwise the method proceeds to 614 and terminates.

In operation, method 600 allows an interaural time delay to be generated based on a panning control setting. Method 600 allows sound location by the use of a panning control to be simulated in a manner that more closely approximates the location of an actual sound source than simple panning between a left and right channel without time correction.

Although exemplary embodiments of a system and method of the present invention have been described in detail herein, those skilled in the art will also recognize that various substitutions and modifications can be made to the systems and methods without departing from the scope and spirit of the appended claims.

What is claimed is:

1. An apparatus for processing audio data comprising:

means for receiving a plurality of channels and determining a time delay between peak magnitudes for a plurality of frequency bands;

and an interaural time delay correction factor insertion unit for modifying the plurality of channels of audio data as a function of an interaural time delay correction factor.

2. The apparatus of claim 1 wherein the interaural time delay correction factor insertion unit comprises means for modifying the plurality of channels of audio data as the function of the interaural time delay correction factor.

3. The apparatus of claim 1 wherein the interaural time delay correction factor insertion unit comprises means for delaying a channel of audio data by an amount related to a delay of the interaural time delay correction factor unit.

* * * * *